United States Patent [19]

Savko

[11] 4,390,122

[45] Jun. 28, 1983

[54] AUTOMATIC SIGNAL FLAG ATTACHMENT FOR A MAILBOX

[76] Inventor: Michael J. Savko, 44 S. Bon Air Ave., Youngstown, Ohio 44509

[21] Appl. No.: 281,886

[22] Filed: Jul. 9, 1981

[51] Int. Cl.[3] ..... B65D 91/00

[52] U.S. Cl. ..... 232/35; 232/34

[58] Field of Search ..... 232/35, 34, 36, 37

[56] References Cited

U.S. PATENT DOCUMENTS

| | | | |
|---|---|---|---|
| 780,509 | 1/1905 | Kitchen | 232/35 |
| 2,812,130 | 11/1957 | Abell | 232/35 |
| 2,874,896 | 2/1959 | Hickman | 232/35 |
| 4,202,486 | 5/1980 | Tipsword | 232/35 |

*Primary Examiner*—Gene Mancene
*Assistant Examiner*—John G. Weiss
*Attorney, Agent, or Firm*—Harpman & Harpman

[57] ABSTRACT

An automatic signal attachment for a mailbox which automatically raises a signal flag to indicate that the mailbox door has been opened. The attachment comprises a lever and pivot assembly for the existing signal flag and a trigger clip and spring assembly to activate the signal flag to a vertical position. The attachment can be used on any standard mailbox now in use.

1 Claim, 4 Drawing Figures

AUTOMATIC SIGNAL FLAG ATTACHMENT FOR A MAILBOX

BACKGROUND OF THE INVENTION (1) Field of the Invention

This invention relates to standard outdoor mailboxes that have signal flags to indicate when the mailbox door has been opened (2) Description of the Prior Art Prior art mailbox devices have used a number of different ways to activate and move the signal flag automatically. See for example U.S. Pat. Nos. 2,874,896; 2,812,130 and 4,202,486.

U.S. Pat. Nos. 2,874,896 and 2,812,130 show fairly complicated signal activation mechanisms which rely on various levers, springs and pins to move the signal flag upon opening of the mailbox door.

Applicant's device requires only three basic components and can be retro-fitted to any standard mailbox currently in use.

U.S. Pat. No. 4,202,486 discloses a spring activated horizontally extending lever system that does not suggest applicant's unique combination which will be disclosed herein.

SUMMARY OF THE INVENTION

An automatic signal attachment for a mailbox allows a standard mailbox to be easily converted so that when the door is opened the signal flag will automatically raise. The attachment comprises a lever and pivot assembly to replace the standard pivot sleeve on the signal flag, a trigger clip attached to the edge of the mailbox door to engage the lever, and a spring assembly attached to the lever to activate the signal flag when the mailbox door is opened.

DESCRIPTION OF THE PREFERRED EMBODIMENT

Figure 1:
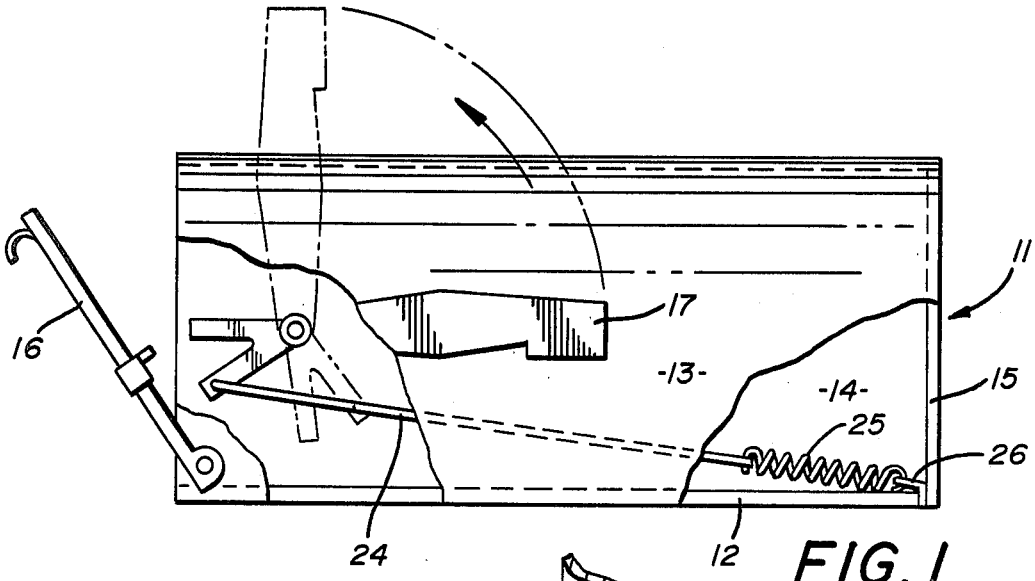
FIG. 1 is a side elevational view of the signal attachment installed on a mailbox with parts broken away.

Referring to FIG. 1 of the drawings, a mailbox 11 can be seen having a bottom 12 with integral side walls 13 and 14 extending therefrom forming an enclosure, one end of which is closed as at 15 and the other end having a pivoted door 16 secured thereto.

Figure 2:
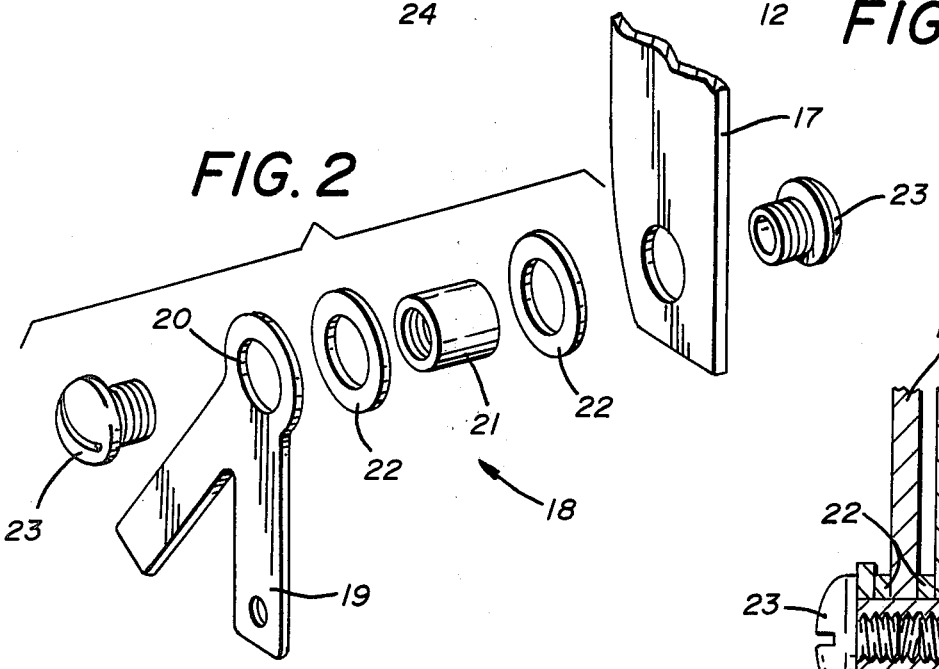
FIG. 2 is an exploded perspective view of the main elements of the signal attachment.

A signal flag 17 is pivotally positioned on the side wall 13 adjacent the door 16 and can be moved from a generally horizontal position alongside the side wall 13 to a vertical position indicated in dotted lines. An automatic signal attachment is comprised of a lever and sleeve assembly 18 best seen in FIGS. 1,2 and 3 of the drawings, having a bifurcated lever member 19, the end of which is enlarged and apertured at 20. The lever 19 is secured to the apertured lower end of the signal flag 17 by an internally threaded sleeve 21, spacing washers 22, and a pair of fastener bolts 23.

Figure 3:
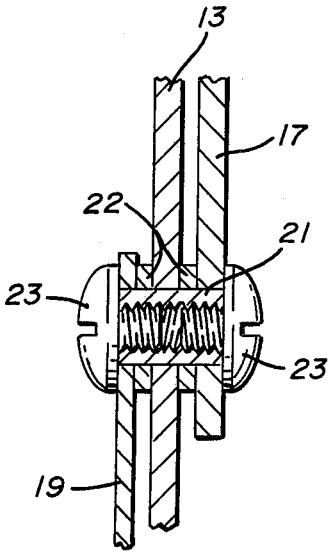
FIG. 3 is a cross sectional view of the main elements of the signal attachment assembled on the mailbox.

Referring to FIG. 3 of the drawings in particular, it will be seen that once the signal flag 17 has been removed from the mailbox, it is reassembled in the same opening in the side wall 13 by first inserting the sleeve 21 therein and placing on it a washer 22, the bifurcated lever 19, and one of the bolts 23 on the inside of the mailbox 10. The washer 22, the signal flag 17 and remaining bolt 23, are assembled on the sleeve 21 on the outer side of the side wall 13. This assembly secures the lever 19 to the signal flag 17 and allows both to move together freely in the side wall 13. One branch of the bifurcated lever 19 is apertured at its end from which extends a rod 24 as seen in FIG. 1 of the drawings. The rod 24 is attached to a spring 25, the other end of which is secured to an L-shaped mounting clip 26 wedged between the bottom 12 and the closed end 15.

Figure 4:
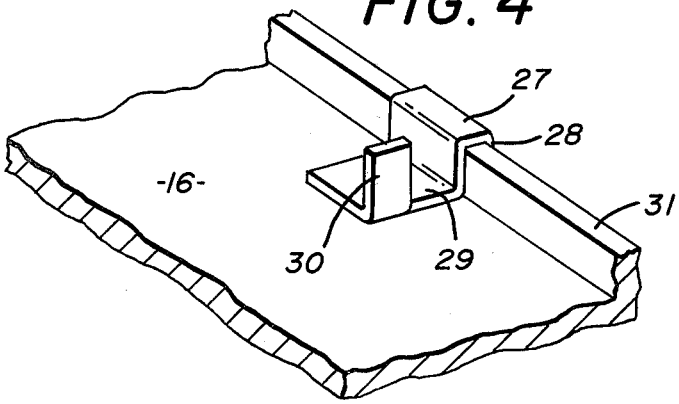
FIG. 4 is a perspective view of the trigger clip on the door of a mailbox.

A trigger clip 27, as best seen in FIGS. 1 and 4 of the drawings, has a U-shaped portion 28 from which extends a flange 29. The flange 29 has a tab 30 extending at right angles therefrom parallel to the U-shaped portion 28 adjacent its end. The clip 27 is frictionally engaged on an upturned lip 31 of the door 16 so as the door is closed it will engage and hold the bifurcated lever 19 and attach the signal flag 17 in a horizontally stored position.

In use, when the door 16 is closed, the signal flag 17 is held down along the side wall 13 by the trigger clip 27 against the tension of the spring 25 on the rod 24. When the door is opened, the trigger clip releases the bifurcated lever 17 along with the signal flag 17 rotates on the sleeve 21 moving the signal flag 17 to a raised vertical position that indicates that a mailbox door has been opened.

It will thus be seen that a new and novel mailbox attachment has been illustrated and described that can be used to easily convert any standard mailbox to an automatic signal flag configuration.

It will be apparent to those skilled in the art that various changes and modifications may be made therein without departing from the spirit of the invention, and having thus described my invention,

What I claim is:

1. An automatic signal flag attachment for use on a mailbox comprises, in combination, a mailbox having an opening in one end and a hinged door therefor movable toward and away from said opening, a V-shaped lever apertured at its apex, a pivot sleeve and an apertured signal flag, said V-shaped lever, pivot sleeve and signal flag assembled in fixed relation to one another on a two part bolt positioned through an aperture in said mailbox adjacent said opening, means urging said V-shaped lever, pivot sleeve and signal flag to a first position, said means including a spring and rod assembly secured to said V-shaped lever and to said mailbox, a trigger device having a clip portion arranged for frictional attachment to said door, a member on said trigger device normally engaging said V-shaped lever between the arms of said V-shape, said V-shaped lever and said signal flag being movable to a second position in response to movement of said V-shaped lever when said trigger device is moved with said door away from said V-shaped lever.

* * * * *